US006036545A

United States Patent [19]

Caviness et al.

[11] Patent Number: 6,036,545

[45] Date of Patent: Mar. 14, 2000

[54] DECOUPLED BNC CONNECTOR

[75] Inventors: Mark Swain Caviness; Michael Joseph Tomchak, both of Harrisburg, Pa.

[73] Assignee: The Whitaker Corporation, Wilmington, Del.

[21] Appl. No.: 08/971,949

[22] Filed: Nov. 17, 1997

Related U.S. Application Data

[63] Continuation-in-part of application No. 08/761,451, Nov. 27, 1996, abandoned.

[51] Int. Cl.[7] ..... H01R 13/66

[52] U.S. Cl. ..... 439/620; 439/181

[58] Field of Search ..... 439/620, 63, 181, 439/581, 607, 944, 108; 361/111, 119, 128

[56] References Cited

U.S. PATENT DOCUMENTS

| | | | |
|---|---|---|---|
| 3,980,382 | 9/1976 | Reeder . | |
| 4,772,221 | 9/1988 | Kozlof | 439/549 |
| 4,828,506 | 5/1989 | Tuckwood | 439/181 OR |
| 4,884,982 | 12/1989 | Fleming et al. | 439/620 |
| 5,062,811 | 11/1991 | Hackman | 439/620 |
| 5,108,300 | 4/1992 | Weber | 439/620 X |
| 5,215,478 | 6/1993 | Briones | 439/620 |
| 5,326,280 | 7/1994 | Briones et al. | 439/581 |
| 5,522,738 | 6/1996 | Lace | 439/181 X |
| 5,557,068 | 9/1996 | Chung | 439/620 X |
| 5,820,393 | 10/1998 | Edgley et al. | 439/181 OR |

FOREIGN PATENT DOCUMENTS 0 181 306 A2 5/1986 European Pat. Off. .

OTHER PUBLICATIONS

International Search Report PCT/US96/17438.

*Primary Examiner*—Paula Bradley
*Assistant Examiner*—Daniel Wittels

[57] ABSTRACT

A board mountable BNC type electrical connector (10) is provided which offers enhanced performance, through direct grounding of the connector to the board and a spark gap feature that protects the connector against exposure to elevated voltages. A grounding clip (76) includes a board locking feature (84), a spark gap tab (74) that seats within the connector housing (12), and a pair of flexible arms (82) arranged to compressively hold a pair of capacitive elements (68) within the connector (10).

12 Claims, 5 Drawing Sheets

DECOUPLED BNC CONNECTOR

This application is a continuation in part of prior application Ser. No. 08/761,451 filed on Nov. 27, 1996, now abandoned.

BACKGROUND OF THE INVENTION

This invention is directed to an electrical connector and more particularly to an improved BNC type, panel mount electrical connector.

Capacitively decoupled connectors were developed several years ago as a way to reduce noise and eliminate ground loops on coaxial interconnections. The highfrequency noise generated by fast rise times can cause both false triggering of circuits as well as emissions that can be radiated or conducted outside the equipment. Such emissions can interfere with nearby equipment. Ground loops are also a problem for networked systems. Ground loops are caused when two interconnected units are at different voltage potentials.

One early approach to handling such EMI and ground loop problems was to decouple the cable shield from the ground panel by soldering a ceramic disk capacitor between the cable shield and the panel. The capacitor shunts high-frequency noise to ground. While effective, this approach is time consuming and expensive. Another approach is found in U.S. Pat. No. 4,884,982, assigned to the assignee hereof, where the teachings thereof are incorporated in this application in their entirety. The BNC type connector, as taught by the patent, has built-in chip capacitors. These capacitors establish the electrical contact between the outer shield and a clip. The clip provides a short electrical path between the capacitors and panel. As a result, high-frequency noise is effectively shunted to ground, while any DC signals are blocked.

Another feature of the patented device is the inclusion therein of a voltage discharge path between the clip and the shell of the connector. This feature, which preferably incorporates a dielectric wafer, such as glass, mica or ceramic, in the path, protects the connector and capacitors from exposure to elevated voltages.

A problem exists with this design in that there is no direct ground connection to a circuit board. The ground connection is achieved by a ground path passing through a conductive panel.

SUMMARY OF THE INVENTION

It is therefore an object of this invention to provide a direct ground connection and board retention for such a decoupled BNC connector.

The object of the invention has been achieved by providing an improved decoupled BNC type connector for mounting to a planar electronic device, such as a printed circuit board. The connector is constructed to offer direct grounding thereof to the planar electronic device and is provided with voltage surge protection. The connector comprises a generally rectangular dielectric housing portion containing an insulated inner transmitting contact for engagement with the planar electronic device, an insulated conductive shell thereabout, and a pair of aligned electrical capacitor elements in contact with the shell through the housing portion. The improvement lies in the use of a grounding clip having a pair of arms arranged on the housing portion to compressively engage the capacitor elements. The grounding clip further includes an intermediate base between the arms and is positioned to lie between the housing portion and the planar electronic device for grounding directly thereto. For the voltage protection, the housing portion includes an opening extending between the intermediate base and the shell, where the intermediate base includes a tab positioned within the opening, such as by a press fit, and spaced from the shell.

DETAILED DESCRIPTION OF PREFERRED EMBODIMENT

Figure 1:
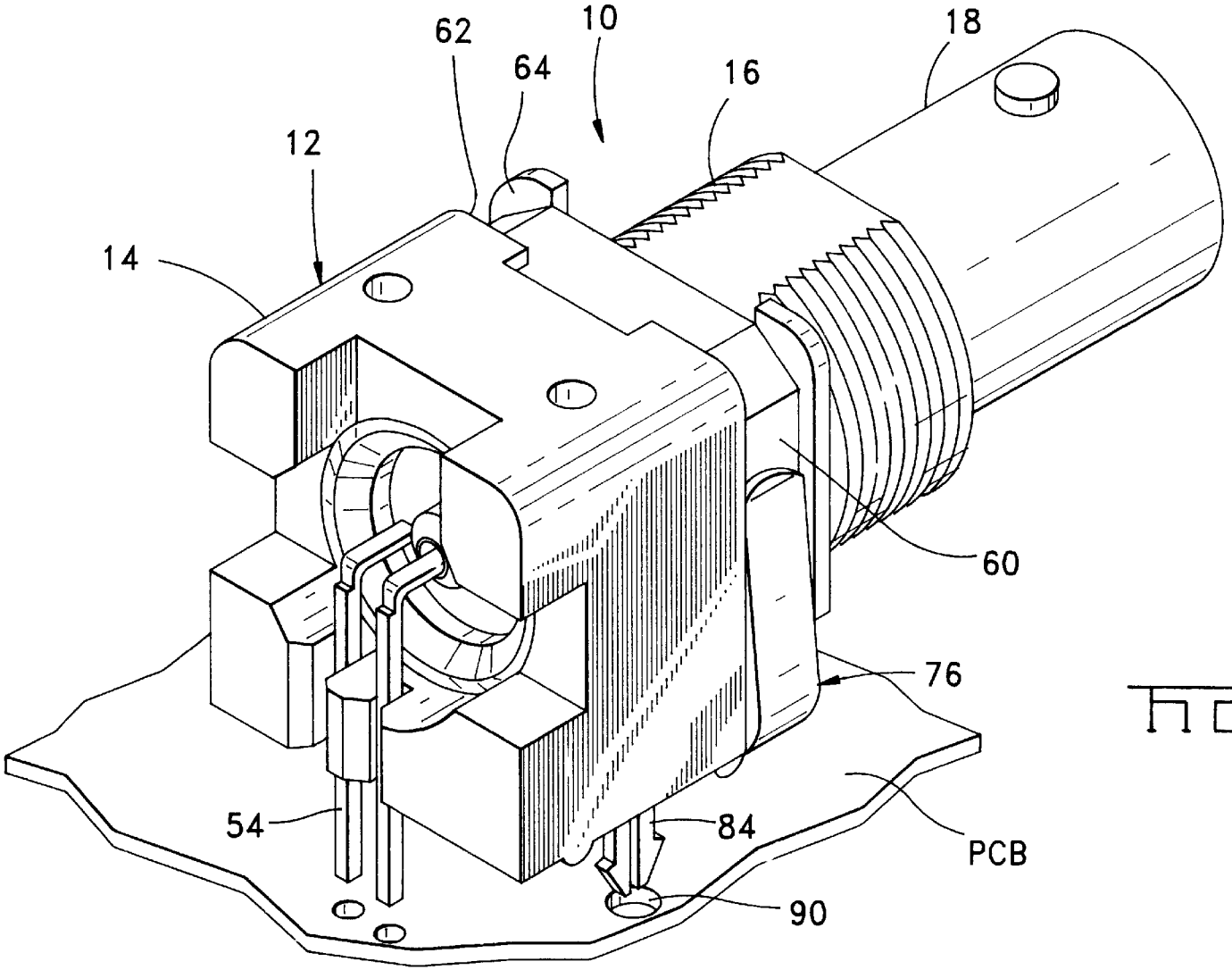
FIG. 1 is a perspective view of a BNC type connector incorporating the improved features of the invention.

This invention relates to an improved, surface mount, BNC type connector, as illustrated in the several Figures. Considering first the overall views of FIGS. 1 and 2, there is shown a connector 10 having a fabricated body 12, such as by injection molding with plastic, where such body 12 comprises a forward portion 14, having a generally rectangular profile, a mid portion 16 integrally molded to the forward portion, and a rear conductive shell portion 18, a construction generally known in the art.

The forward portion 14 and mid portion 16 include a central through cavity 20 into which the rear conductive shell portion 18 is received. To secure the respective portions into an integral unit, an external projecting key 22 of the shell portion 18 extends along a keyway 24 in the forward portion 14 extending from the end 26. Relative movement of the shell 18 is prevented by a rear facing shoulder 26 of the shell 18 that faces the end 26 and by a thin flange 28 of a rear end of the shell 18 outwardly flared, after insertion into the through cavity 20, to engage against a flared rear of the cavity 20.

Within the conductive shell portion 18, there is provided a hollow insulative liner 30 for the shell portion 18 which extends within an axial, stepped cylindrical passage 32. An external step shoulder 33 of the liner 30 engages an interior, front facing, step shoulder 34 of the shell portion 18. A forward portion 36 of the liner 30 is of reduced diameter and projects concentrically into the disconnect coupling portion 38 of the shell portion 18.

Figure 2:
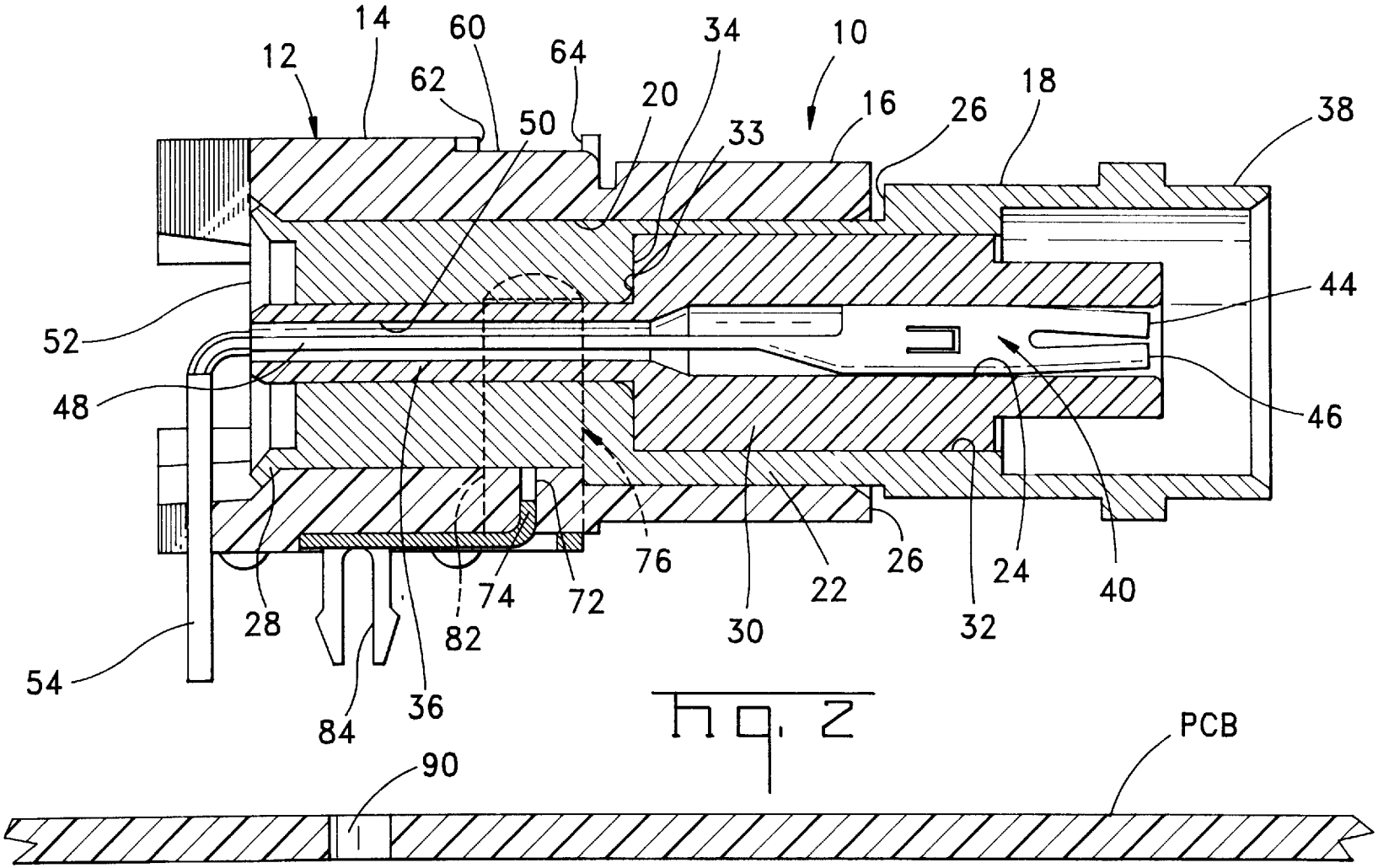
FIG. 2 is a longitudinal sectional view of the BNC type connector illustrated in FIG. 1.
Figure 3:
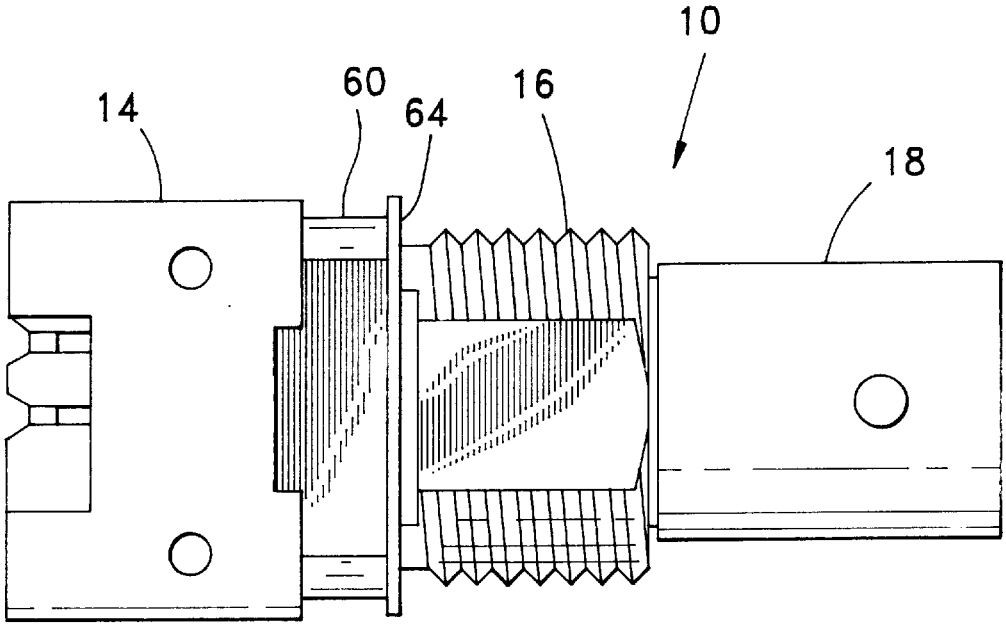
FIG. 3 is a top view of the BNC type connector illustrated in FIGS. 1 and 2.
Figure 4:
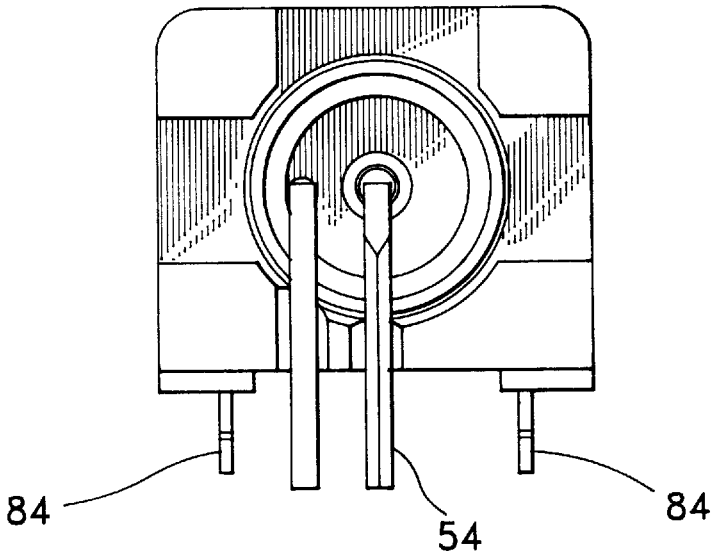
FIG. 4 is an end view of connector according to this invention.
Figure 5:
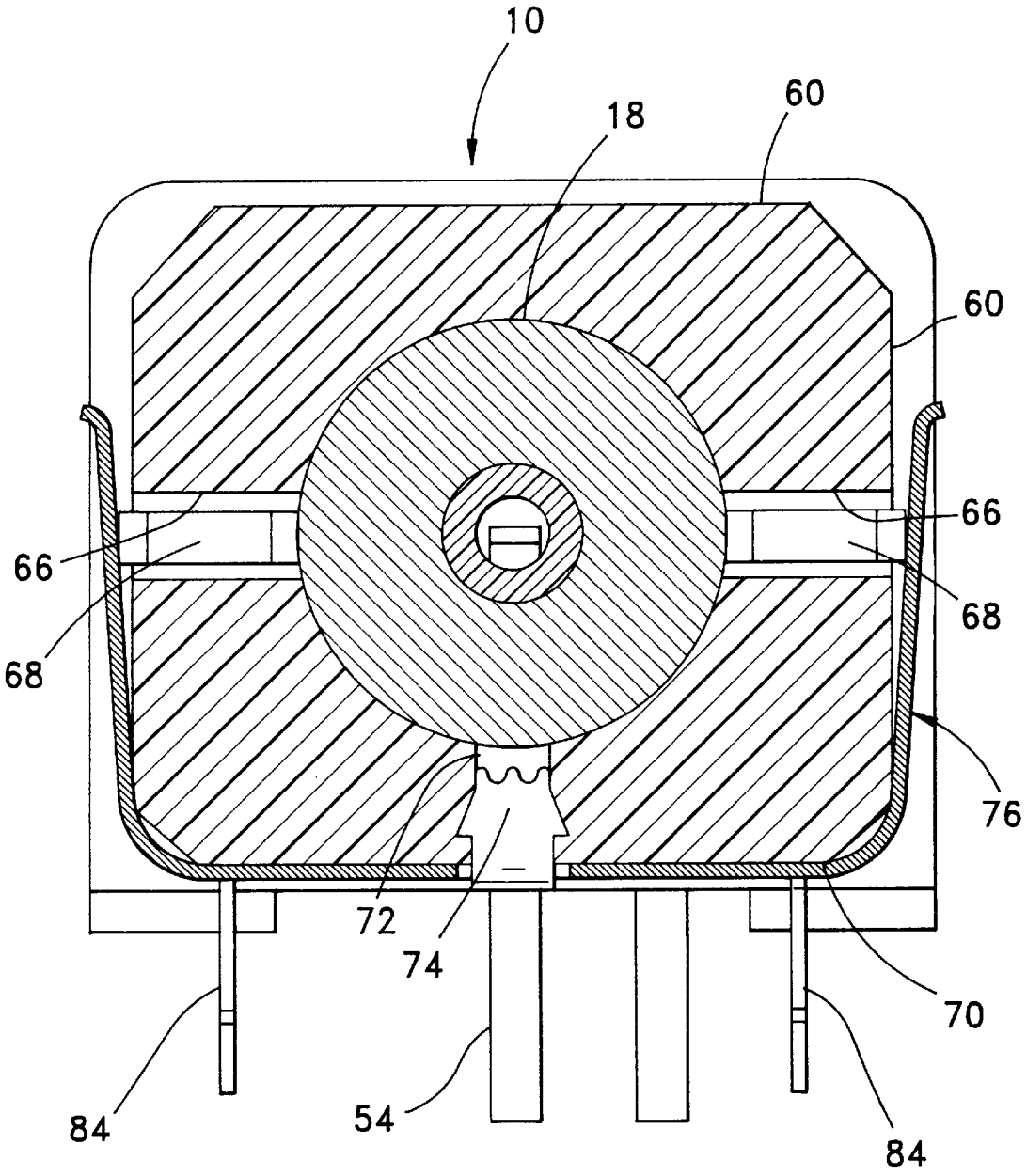
FIG. 5 is an enlarged transverse sectional view taken through a plane within the grounding clip, as hereinafter described.

A conductive electrical contact 40, known as a center contact, of stamped and formed metal strip extends concentrically within the liner 30 along a stepped passage 24 of the liner 30. A unitary, disconnect contact portion 44 includes a hollow cylindrical electrical receptacle formed by bending the strip into a hollow cylindrical shape. An open front end 46 of the contact portion 44 faces forward and is concentrically within the liner 30. An elongated portion 48 of the contact 40 extends concentrically along a reduced diameter portion 50 of the passage 24 and projects beyond an end 52 of the liner 30 to provide an electrical terminal 54, bent 90°, for pluggable receipt into a planar electronic device, such as a printed circuit board. The connector 10 of this invention is a BNC type coaxial connector which has an exterior profile similar to that of known BNC type connectors. The forward portion 14, as best illustrated in FIG. 1, is generally of a rectangular shape, with a groove 60, or reduced cross sectional area, about the rear thereof. The groove 60 is defined by the forward shoulders 62 and rearward panel stops 64. As best seen in FIG. 5, the respective sides of the groove 60 are provided with a pair of axially arranged slots 66, each receiving a capacitor element 68. Along the base 70 of the groove 60 is a further slot 72, the function of which is to receive a spark gap tab 74, as hereinafter described.

Figure 6:
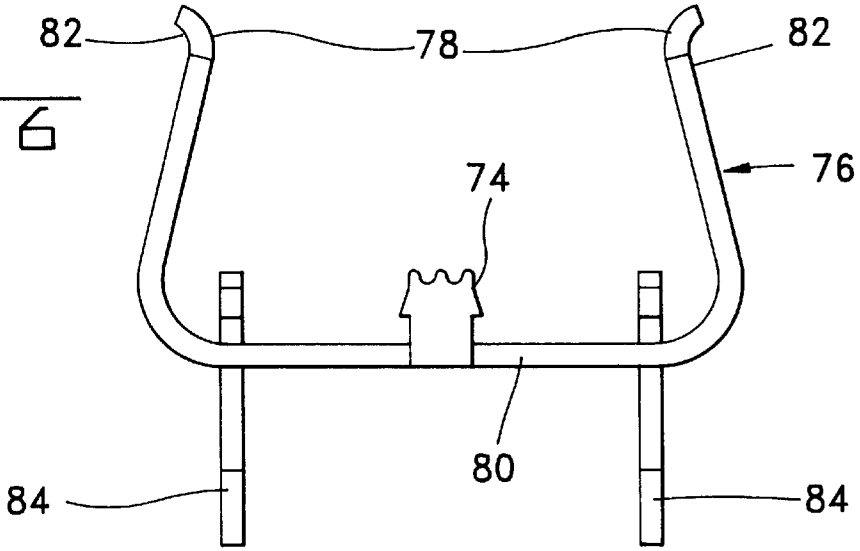
FIG. 6 shows an end view of the stamped and formed metal grounding clip used in the BNC type connector of this invention.
Figure 8:
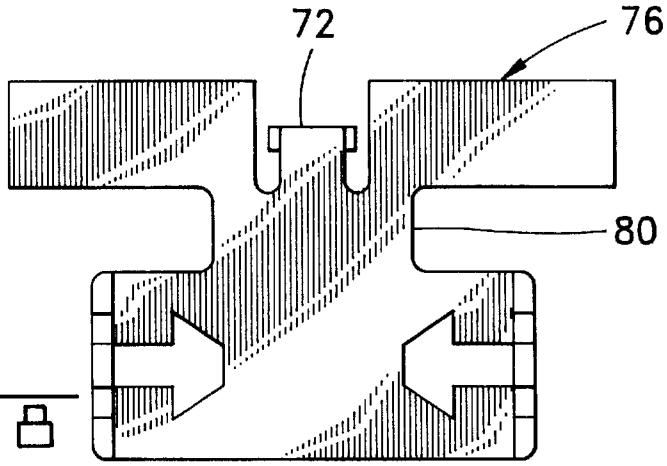
FIG. 8 show a bottom view of the stamped and formed metal grounding clip used in the NBC type connector of this invention.
Figure 7:
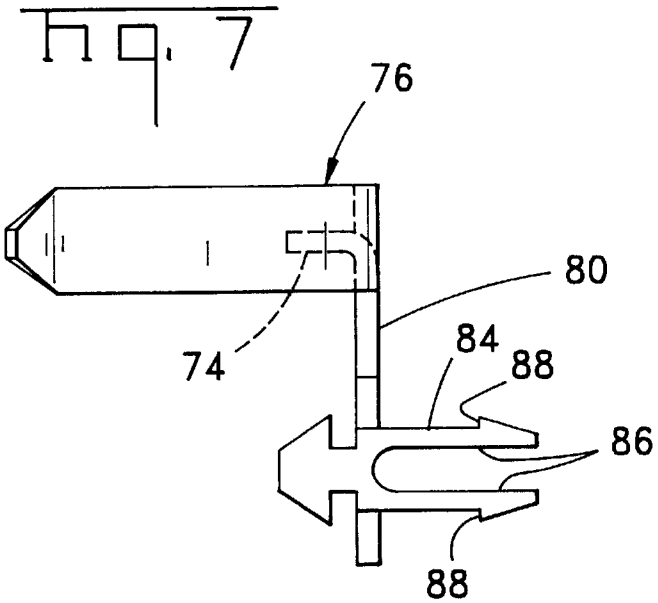
FIG. 7 shows a side view of the stamped and formed metal grounding clip used in the BNC type connector of this invention.

FIGS. 6 to 8 respectively are front, side and bottom views of the grounding clip 76 for use on the connector 10 of this invention. The grounding clip 76 is formed from a flat metal blank resilient spring metal, such as phosphor bronze. The clip 76 includes a curvilinear yoke 78 having a base 80 and spaced apart arms 82 inclined toward one another, see FIG. 6. Projecting down from the base 80 are a pair of board locks 84, each consisting of a pair of flexible legs 86 with an outwardly directed barb 88 for engagement with an appropriate grounding hole 90 (FIG. 1) in the planar electronic device to which it is to be mounted.

As noted previously, the underside of the forward portion 14, aligned in the groove 60, is provided with a slot 72 which is open to the shell 18 (FIG. 5). The purpose of the slot 72 is to receive the upturned, spark gap tab 74 projecting above the base 80. By proper sizing and bending of the spark gap tab 74, one can ensure a critical spacing or air gap between the shell 18 and the end of spark gap tab 74, (see FIGS. 2 and 5). The free or spaced apart arms 82 are positioned along the sides of groove 60 to apply a compressive force to the pair of capacitor elements 68. The clip 76 may also be assembled in the groove 60 in the absence of a corresponding capacitor element 68.

The present invention offers all the advantage of direct grounding of the connector to the planar electronic device to which the connector is mounted. By this approach, elimination of the grounding path through a conductive panel, there is lower inductance and improved performance. These and other features will become apparent to those skilled in the art from reading these specifications, particularly when read in conjunction with the accompanying drawings.

We claim:

1. A clip for partially surrounding an insulative housing of an electrical connector and for securing electrical components therein comprising:

a base for engaging a first surface of the insulative housing, a pair of cantilever arms extending from the base to engage second and third opposing surfaces of the insulative housing, a spark gap tab extending from the base into an opening of the insulative housing, and;

at least one board lock projection extending from the base for engaging an opening in a printed circuit board.

2. The clip as recited in claim 1 wherein the pair of arms are angled to extend from the base and toward each other.

3. The clip as recited in claim 1 wherein the spark gap tab further comprises a pair of locking lances disposed along opposite edges of the tab for cooperation with inner walls of an opening of the insulative housing.

4. The clip as recited in claim 3 wherein the spark gap tab extends from the base into the insulative housing of the electrical connector to a point which is spaced from a conductor of the electrical connector such that an air gap is formed between the spark gap tab and the conductor.

5. The clip as recited in claim 1 wherein the boardlock further comprises a pair of legs extending from the boardlock, each of the legs having a retention barb disposed along an edge near the a distal end.

6. The clip as recited in claim 5 wherein the boardlock further comprises a locking tab which extends into the insulative housing and is secured thereto by the cooperation of the locking tab with a boardlock receiving opening in the insulative housing.

7. A decoupled coaxial connector having a center conductor, a dielectric insert surrounding the center conductor and an outer conductor surrounding the dielectric insert, the outer conductor being disposed inside an insulative housing and a clip partially surrounding the insulative housing and extending over slots which are in communication with the outer conductor for holding electrical components in the slot, the connector characterized by:

the clip having a pair of arms extending from a base toward the insulative housing, a spark gap tab extending from the base into an opening in the insulative housing and at least one board lock projection extending from the base away from the housing for engaging an opening of a circuit board and for securing the electrical connector thereto.

8. The electrical connector as recited in claim 7 wherein the pair of arms are angled to extend from the base and toward each other.

9. The electrical connector as recited in claim 7 wherein the spark gap tab further comprises a pair of locking lances disposed along opposite edges of the tab for cooperation with inner walls of the opening of the insulative housing.

10. The electrical connector as recited in claim 9 wherein the spark gap tab extends from the base into the housing to a point which is spaced from the outer conductor such that an air gap is formed between the spark gap tab and the outer conductor.

11. The electrical connector as recited in claim 7 wherein the boardlock further comprises a pair of legs extending from the boardlock, each of the legs having a retention barb disposed along an edge near the a distal end.

12. The electrical connector as recited in claim 11 wherein the boardlock further comprises a locking tab which extends into the insulative housing and is secured thereto by the cooperation of the locking tab with a boardlock receiving opening in the insulative housing.

* * * * *